United States Patent [19]

Conn et al.

[11] Patent Number: 4,508,577

[45] Date of Patent: Apr. 2, 1985

[54] FLUID JET APPARATUS AND METHOD FOR CLEANING TUBULAR COMPONENTS

[75] Inventors: Andrew F. Conn, Baltimore; William T. Lindenmuth, Columbia; Gary S. Frederick, Reisterstown, all of Md.

[73] Assignee: Tracor Hydronautics, Inc., Laurel, Md.

[21] Appl. No.: 489,771

[22] Filed: Apr. 29, 1983

[51] Int. Cl.[3] ..... B08B 9/02

[52] U.S. Cl. ..... 134/1; 134/22.12; 134/23; 134/24; 134/167 C

[58] Field of Search ..... 134/1, 22.12, 24, 167 C, 134/23

[56] References Cited

U.S. PATENT DOCUMENTS

| | | | |
|---|---|---|---|
| 3,427,763 | 2/1969 | Maasberg et al. | 51/411 X |
| 3,713,699 | 1/1973 | Johnson | 299/14 |
| 4,193,635 | 3/1980 | Thiruvengadam et al. | 134/1 X |
| 4,389,071 | 6/1983 | Johnson et al. | 134/1 X |

*Primary Examiner*—Marc L. Caroff

*Attorney, Agent, or Firm*—Finnegan, Henderson, Farabow, Garrett & Dunner

[57] ABSTRACT

Fluid jet apparatus and method for cleaning material from the inside of a tubular conduit utilizing a cleaning head that lies adjacent to one wall of the conduit and includes at least two fluid jet forming means for directing a plurality of high pressure fluid cutting jets in a forward direction and at an acute angle relative to the axis of the head and the conduit so that they are directed toward the opposite wall of the conduit. The cleaning head is rotated around and remains adjacent to the wall of the conduit and is advanced into the conduit as the jets cut away the material whereby the fluid jets create an asymmetric cutting pattern on the surface of the material and the counter thrust of the fluid jets keeps the cleaning head offset relative to the axis of the conduit and against the wall of the conduit to provide passage for removal of the cut material and spent fluid away from the cutting area and out the end of conduit.

35 Claims, 6 Drawing Figures

FLUID JET APPARATUS AND METHOD FOR CLEANING TUBULAR COMPONENTS

This invention relates to a method and apparatus for fluid jet cleaning deposits from the interior of tubular components such as conduits. More particularly, this invention relates to a new and improved water jet cleaning head that is constructed and operated to form an asymmetric cutting pattern on the deposit in the conduit, especially cement-filled metal pipe.

BACKGROUND OF THE INVENTION

An unwanted by-product which occurs during the process of completing deep-holes drilled for either gas, oil, or geothermal energy is a number of steel drill pipes that are either partially or fully plugged with cement. This occurs during that step in the completion of the well when cement is pumped down the drill string and thence up the annulus between the rock wall of the hole and the steel casing which has been inserted into the well. Plugging of metal pipes and tubes also frequently occurs in heat exchangers in petrochemical plants and refineries. In this case the deposit in the tubes is a hydrocarbon-based chemical compound which may be very difficult to remove.

The common approach to removing tube or pipe plugging deposits involves the use of high pressure water jet systems. These systems typically use a water jet cleaning nozzle having a symmetrical cylindrical shape and provided with one or more nozzle orifices. These nozzles may be located so as to jet both up and down relative to the axis of the nozzle and forward and backward relative to the movement of the nozzle through the pipe. The nozzle is usually mounted on the end of hollow lance or long shaft through which the water is fed from a pump to the nozzle orifices. Often means are provided to rotate the nozzle about its axis and to advance the lance into the pipe so that the jets issuing from the nozzle orifices can contact the complete inside surface of the pipe or tube. Due to the symmetrical configuration of the conventional nozzles and the typical operation of a conventional system for feeding the lance, the nozzles tend to be centrally located within the pipe.

An example of such a system for cleaning pipes or tubes is U.S. Pat. No. 3,646,947 to W. R. Rochelle et al. In Rochelle there is disclosed a nozzle for a water jet pipe cleaning system having a series of high pressure fluid jet nozzle orifices spaced around its circumference. The head is centrally located relative to the pipe and is rotated about its axis creating a symmetrical cutting pattern on the deposit in the pipe, the fragmented material and spent fluid passing back between the nozzle and the inside wall of the pipe.

Similar high pressure water jet nozzles used for drilling, but which could also be used for cleaning pipe, include nozzles of the type shown and described In U.S. Pat. No. 4,119,160 to Summers et al. and U.S. Pat. No. 4,306,627 to Cheung et al. In each case the nozzle is rotated about its axis so that the jet forms a generally symmetrical cutting pattern on the face of the material being drilled. In Cheung in FIG. 4 and in Summers in FIG. 2 these symmetrical cutting patterns are shown as cones which form in front of the drilling nozzle and are successively removed as the nozzle is rotated and advanced into the drilled hole. A similar pattern would be created by these nozzles on material deposited in a pipe.

It has been observed, however, that when removing material in a pipe with a symmetrical nozzle, as opposed to drilling in an unconfined environment, large segments of the deposit having the diameter of the inside of pipe have the tendency to break off and jam against the nozzle limiting its rate of progress and possibly damaging it. This is due to the low pressure areas created in the trough of the symmetrical cones as the spent fluid from the nozzles rapidly changes direction and passes out the back of the pipe with the removed fragments, as well as the leaking of the high pressure fluid down along the sides of the deposit. These forces, acting together on flaws or cracks in the deposit ahead of the advancing nozzle, can break off a plug of the deposit and pull it up against the nozzle. The symmetrical nozzles also tend to create too large pieces of the deposit which jam up in front of the nozzle interferring with its progress or, because of their size, are difficult to transport out of the pipe.

These systems generally require the use of one or more pumping machines, each having a pressure capacity of 10,000 psi to 15,000 psi and flow capacities of up to 20 gallons/minute. The removal of the material from the steel pipes with such systems, however, has been extremely slow and in some instances the pipes are so severly plugged that cleaning cannot be achieved within an economically practical period of time. A typical rate, for example, for removing fully cured cement from pipe having an inside diameter of 2" to 3" with a conventional water jet system has been only about 0.5 feet/minute.

It is therefore desirable to provide a system for cleaning deposits from the inside of pipes that has a sufficient jet erosion capability to rapidly cut through the unwanted deposit and that cuts the deposit into segments that are neither too small, which wastes time and energy, nor too large, which causes jamming inside the pipe.

SUMMARY OF THE INVENTION

In accordance with the present invention it has been found that such objects can be achieved with a high pressure fluid jet cleaning head constructed and operated in the pipe such that it creates an asymmetric cutting surface on the deposit in the pipe. With the system of the present invention it is possible to achieve up to a 12-fold increase in the rate of removal of cement deposits in pipe over conventional prior art systems using nozzles constructed and operated in a symmetrical configuration.

More particularly, the present invention provides apparatus for fluid jet cleaning material from the inside of a tubular component comprising a source of high pressure fluid, an elongated member for running into one end of the tubular component and a nozzle body affixed to the free end of the elongated member with the nozzle body having an internal chamber and a forward end. At least two fluid jet forming means are mounted on the forward end of the nozzle body and in fluid communication with the chamber for directing a plurality of high pressure fluid cutting jets in a forward direction and at an acute angle relative to a plane parallel to the axis of the conduit so that they are directed toward only one wall of the conduit. The system further includes means for locating the nozzle body adjacent to the wall of the tubular component opposite from said one wall, means for communicating the chamber with a high pressure fluid source and means for providing a relative motion between the tubular component and the nozzle body so that the nozzle body moves around and remains adjacent to the wall of the tubular component opposite from said one wall. Means are also provided for advancing the elongated member and the attached nozzle body into the tubular component as the jets cut away the material. In this manner, the fluid jets create an asymmetric cutting pattern on the surface of the material while the counter thrust of the fluid jets keeps the nozzle body offset relative to the axis of the conduit and against the wall of the tubular component opposite from said one wall to provide passage for removal of the cut material and spent fluid away from the cutting area between the nozzle body and said one wall and out the end of the tubular component.

The present invention also provides a method for cleaning a tubular component with high velocity fluid jets comprising positioning a nozzle body adjacent to one wall of the tubular component so that the nozzle body is offset relative to the axis of the component, the nozzle body having at least two fluid jet forming means mounted on its forward end for directing a plurality of angled high pressure fluid cutting jets in a direction forward of the nozzle body and toward only the opposite wall of the tubular component so that the jets will form an asymmetric cutting pattern on the surface of the material in the tubular component. High pressure fluid is then supplied to the jet forming means while relatively moving the component and the nozzle body so that the body moves around and remains adjacent to the inside wall of the tubular component and the nozzle body is advanced into the component as the material is cut away.

Preferably, the nozzle body used in the foregoing apparatus and method is frusto-cylindrical in shape having a longitudinal axis and a generally slanted forward face. The two or more fluid jet forming means are mounted on the forward face of the nozzle body, at least one being above the axis and at least one below the axis, and in the same vertical plane passing through the nozzle body's axis, so that the jets are directed forwardly of the nozzle body in the same quadrant lying between a horizontal plane parallel to the nozzle body's axis and a plane perpendicular to the nozzle body's axis. When the nozzle body is located inside and against one wall of the tubular component and rotated around the inside of it, the jets will thus create an asymmetric cutting pattern on the surface of the deposited material in the tubular component.

It is to be understood that both the foregoing general description and the following detailed description are exemplary and explanatory but are not restrictive of the invention.

DETAILED DESCRIPTION OF THE INVENTION

The accompanying drawings which are incorporated in and constitute a part of this specification illustrate several embodiments of the invention and together with the description serve to explain the principles of the invention.

Of the drawings

Reference will now be made in detail to preferred embodiments of the invention, examples of which have been illustrated in the above drawings.

Figure 1:
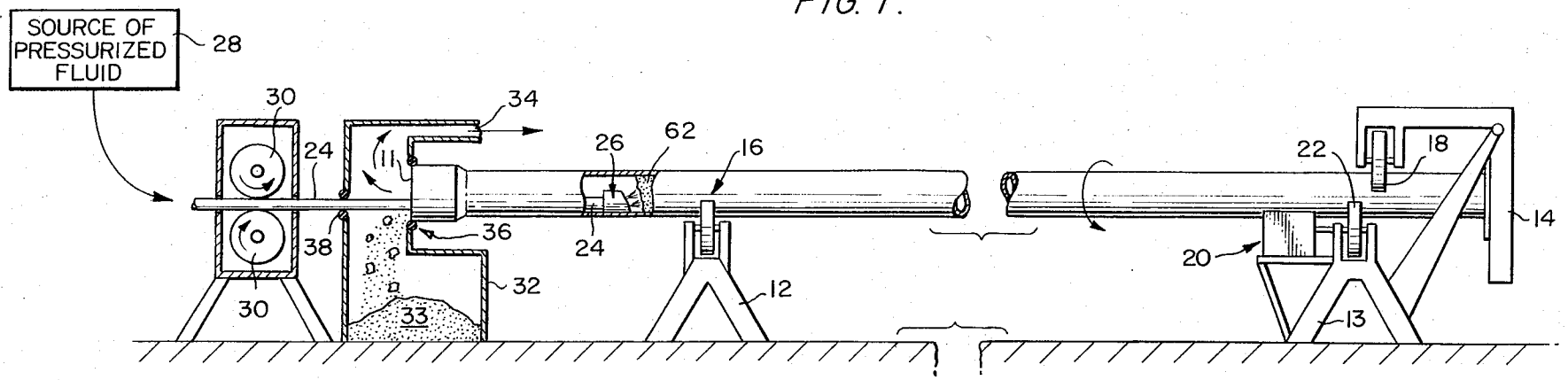
FIG. 1 is a schematic view of the high pressure water jet system of the present invention for cleaning deposits from inside metal pipes.

To illustrate the improvements and advantages realized by the present invention there is shown schematically in FIG. 1 a system for cleaning deposits from the interior of a tubular component, such as pipe, and, particularly, for cleaning cement from the interior of a steel drill pipe stem. The pipe 10 to be cleaned is supported in a generally horizonal manner on a plurality of supporting trestles, 12, 13. While two supporting trestles are shown, the number will obviously vary depending upon the length of pipe to be cleaned. One end 11 of the pipe is left open for insertion of the cleaning head while the other end is held in place by a stop arm 14 attached to end trestle 13.

In the embodiment shown in FIG. 1 means are provided for rotating the pipe about its longitudinal axis while it is supported by the trestles. As embodied this means may consist of a pair of idler rollers 16 (only one of which is shown) rotatably mounted on trestle 12 and spaced apart the required distance depending upon the diameter of the pipe being cleaned. The means further includes a motor 20 mounted on end trestle 13 and suitably geared to a pair of driving rollers 22 (only one being shown) rotatably mounted on trestle 13 to support pipe 10 at its other end and to rotate the pipe about its axis at the desired speed. Thus, idler rollers 16 in combination with driving rollers 22 support pipe 10 horizontally while permitting it to turn about its axis. A further pair of idler rollers 18 are provided on arm 14 that engage the top of pipe 10 to prevent it from shifting during rotation of the pipe.

The system of FIG. 1 further comprises an elongated hollow shaft 24 for mounting the cleaning head 26 on one end and for connecting the head to a supply of pressurized fluid from a source 28. In accordance with the invention translating means are provided for advancing shaft 24 and the attached cleaning head 26 into pipe 10 as the deposit is removed. As embodied this means comprises a pair of driving rollers 30 mounted for rotation on axes perpendicular to the axis of pipe 10 and shaft 24 which grip both sides of shaft 24 and are driven by a suitable reversable motor (not shown) for translating the shaft 24 and cleaning head 26 in and out of pipe 10 at the desired speed.

Means are also provided for maintaining pipe 10 full of fluid during the cleaning to assist in the cutting action on the deposit as well as the removal of cut debris from inside the pipe. As embodied and as shown in FIG. 1 this means comprises a housing 32 surrounding open end 11 of pipe 10. In operation, the housing fills up with spent fluid from the cleaning operation. The debris 33, being transported out the open end of the pipe by the flowing fluid, falls into the bottom of the housing where it can be conveniently removed and the excess fluid passes out through outlet 34 at the top of housing 32 at a level above the pipe thus keeping pipe 10 full of fluid at all times. A suitable seal 36 is provided around the open end of pipe 10 to prevent leakage of the fluid between the pipe and the housing while permitting the pipe to turn. Similar sealing means 38 are provided around shaft 24 to permit the shaft to pass through housing 32 and into pipe 10. Since housing 32 is merely used to collect spent fluid and maintain the pipe full of fluid during the cleaning operation and is not under pressure, the seals need only be tight enough to accomplish this objective. The above-described elements have only been depicted schematically because they are of a conventional nature and do not by themselves, but only in combination, form a part of the present invention.

Figure 2:
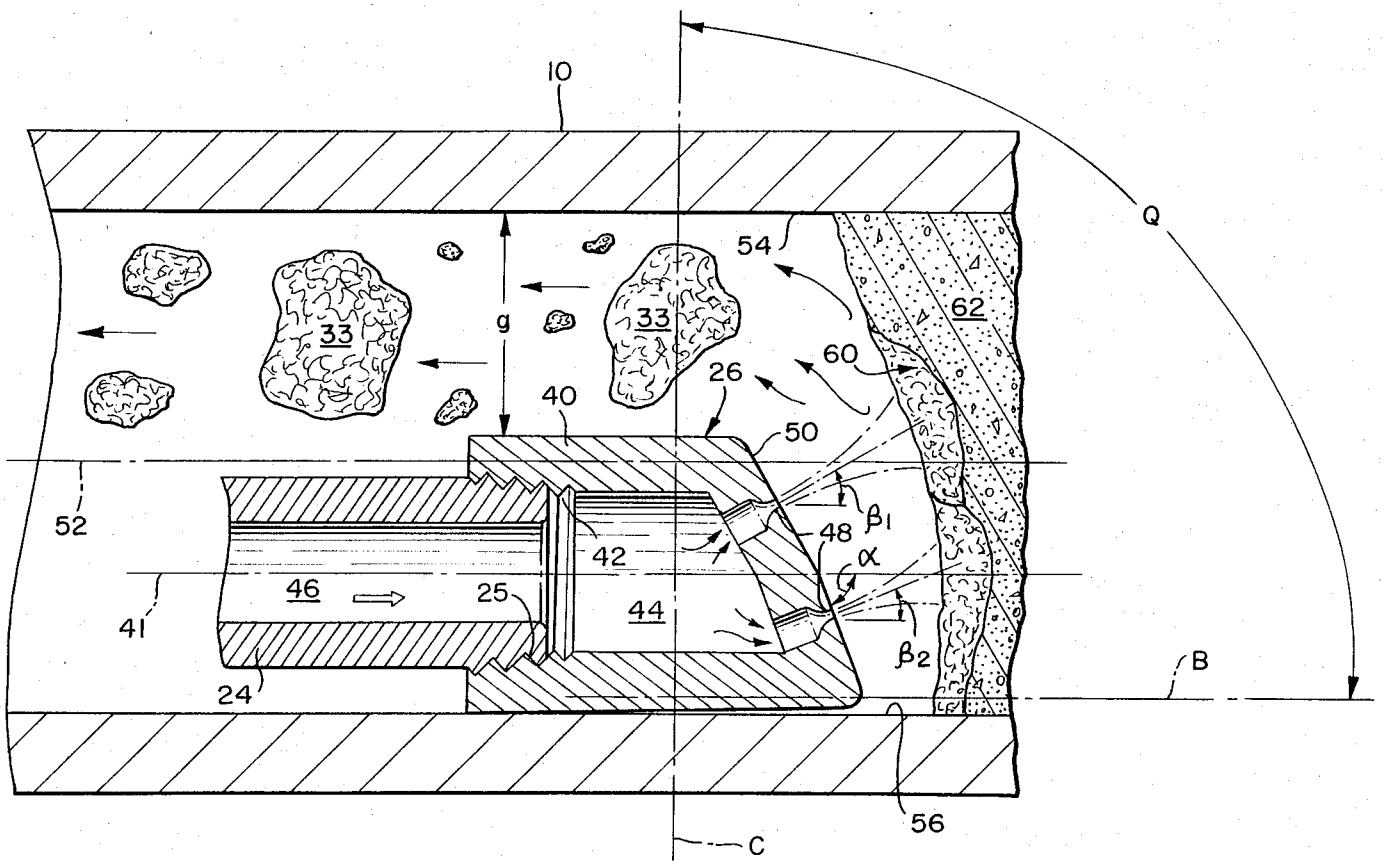
FIG. 2 is an expanded view of the cleaning head used in the apparatus of FIG. 1.

As more particularly shown in FIG. 2, there is provided a new and improved cleaning head 26 for cleaning unwanted deposits from inside of steel pipe and a method for operating this cleaning head. Cleaning head 26 includes a nozzle body 40 provided with internal threads 42 for connection to the threaded end 25 of shaft 24 so that it can be advanced and retracted relative to pipe 10 as shaft 24 is moved back and forth by translating means 30. Nozzle body 40 has an internal chamber 44 communicating with an internal passage 46 in shaft 24 to supply it with high pressure fluid from source 28 and at least two fluid jet forming means 48 mounted on the forward end 50 of the nozzle body that are in fluid communication with chamber 44.

In accordance with the invention, the jet forming means are mounted on nozzle body 40 so as to direct a plurality of high pressure fluid cutting jets forward of the nozzle body and at an upward angle, as shown in FIG. 2, relative to a plane B parallel to the axis 52 of pipe 10 as well as axis 41 of nozzle body 40. While the particular angle of the jets may differ, all of the jets are angled in the same quadrant Q lying between the plane B parallel to the axis of the pipe and a plane C perpendicular to it so that they are directed toward only one inside wall 54 of pipe 10.

As best shown in FIG. 2, cleaning head 26 is offset relative to the axis 52 of the pipe and located adjacent to wall 56 of the pipe opposite from the wall 54 toward which the jet streams are directed so that at least one of the jet streams is directed across axis 52 of the pipe. As more fully described below in connection with the operation of the device, the direction of the nozzles in combination with the location of the cleaning head will create an asymmetric cutting pattern as shown on the face 60 of the deposit 62 in pipe 10. This cutting pattern optimizes the size of the chips 33 removed to maximize the rate of removal of the deposit and the transport of the chips away from the cleaning head and out the back end of the pipe and minimize the risk of a premature breakout of a large plug of the deposit having the diameter of the pipe.

Figure 3:
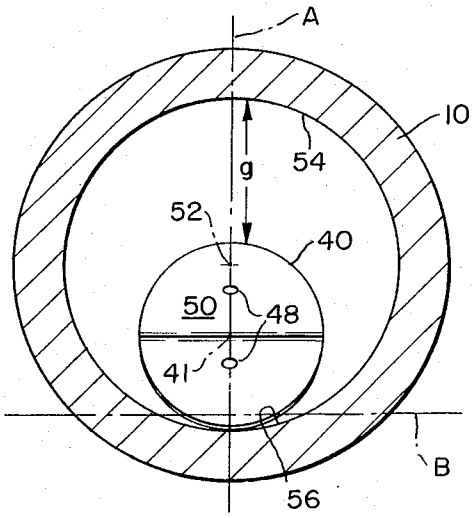
FIG. 3 is a front view of the cleaning head of FIG. 2.

Preferably nozzle body 40 is frusto-cylindrical in shape having a circular cross-section and a slanted face 50. The angle $\alpha$ of face 50 should be from about 50° to 70° and preferably 60° relative to axis 41 of the nozzle body. As best shown in FIGS. 2 and 3, at least one of the plurality of jet forming means 48 is below the axis of the nozzle body and one is above it so that the erosive action of the jets reaches the entire face of deposit 62 during each rotation of the pipe 10, and they are spaced within a vertical plane A that runs through the axis of the nozzle body and the axis of the pipe. Two jet forming means have been found to be adequate for smaller diameter pipes of up to approximately 4 inches in diameter, but with larger pipes a third or additional jet forming means similarly oriented may be required to adequately cover and break up the width of the deposit in the pipe.

To provide the desired asymmetric cutting pattern on the surface 60 of deposit 62, the jet forming means should direct the cutting jets upwardly at an angle of anywhere from about 10° to 50° relative to the axis of the nozzle body and the nozzle body should be located in the pipe so that at least one of the cutting jets and preferably all of the cutting jets cut across the axis 52 of the pipe as shown in FIG. 2. In the two jet embodiment shown in the drawings and for pipe of from 2 to 3 inches in diameter, the top jet should be at an angle $\beta_1$ of between 10° to 50° and the lower jet at an angle $\beta_2$ between 10° and 30°. In addition, and to permit room for the chips broken off from the face of the deposit to be moved away from the cutting area and out the open end of pipe 10, nozzle body 40 should be sized relative to pipe 10 to provide a minimum clearance (g) of approximately 1 to 2 inches between the outer diameter of the nozzle body and the inside diameter of the pipe.

The jet forming means 48 mounted on the forward face of nozzle body 40 may be high velocity water jet nozzles similar to that shown in the patents to Chueng or Summers that typically operate at fluid pressures of up to 40,000 psi or more, and issue jets having diameters of up to 0.1 inches. Preferably, however, the jet forming means used in the system of the present invention are enhanced cavitating liquid jet nozzles which cause substantially more erosion than liquid jet nozzles not utilizing the improved methods and apparatus of the several Johnson patents discussed below when operated at comparable driving pressures and other conditions. Thus enhanced cavitating liquid jet nozzles may be used at substantially lower pressures than the nozzles of the aforementioned Chueng and Summers patents.

Cavitating liquid jet nozzles are specifically designed to maximize production of vapor cavities in the jet streams issuing from their exits. These cavities grow as they absorb energy from the flowing stream and as they approach a solid surface they collapse producing very high local pressures and an intense erosive effect on the solid surface.

In U.S. Pat. No. 3,528,704 to V. E. Johnson, Jr. and assigned to the same assignee as the present invention, there is shown apparatus and a method for drilling with a cavitating liquid jet nozzle in which a liquid jet stream, such as water, having vapor cavities formed therein is projected against a solid surface such that the vapor cavities collapse in the vicinity of the point of impact of the jet with a solid surface. Because the vapor cavities collapse with violence, substantial damage and advantageous erosion can be done to the solid by the jet.

In U.S. Pat. No. 3,713,699, also to V. E. Johnson, Jr. and assigned to the same assignee of the present invention, there is described an improved method for eroding a solid with a cavitating water jet stream in which the jet is surrounded by a relatively stationary liquid medium, generally spent water from the jet. The presence of the surrounding water substantially reduces the loss of the vapor cavities due to venting, which occurs when a jet is formed in air, and promotes the formation of vapor cavities in the stream by the high velocity stream shearing the surrounding water and creating vortices in the shear zone. Both of these factors increase the number of vapor cavities in the jet and hence its destructive force.

The theory and effect of cavitating liquid jets and various nozzle arrangements for forming cavitating liquid jets can be found in the above-mentioned U.S. patents to V. E. Johnson, Jr., as well as U.S. Pat. No.

4,262,757 to V. E. Johnson, Jr. et al. and also assigned to the same assignee as the present invention, which shows a particularly suitable cavitating water jet nozzle for use as the jet forming means of the present invention. In these patents, as well as in the present specification and claims, cavitation refers to the formation and growth of vapor-filled cavities in a high velocity flowing stream of liquid issuing from a suitable nozzle where the local pressure surrounding the gas nuclei in the liquid is reduced below the pressure necessary for the nuclei to become unstable, grow and rapidly form large vapor-filled cavities. This critical pressure is equal to or less than the vapor pressure of the liquid. These vapor-filled cavities are convected along with the jet stream issuing from the nozzle and when the local pressure surrounding the cavities raises sufficiently above the vapor pressure of the liquid the cavities collapse and enormous pressure and potential destruction is created in the vicinity of this collapse. The effect on solids located at this point and exposed to such collapsing cavities is called cavitational erosion. Because various nozzle arrangements and the methods taught for operating these nozzles can be used in the present invention, the teachings of the aforementioned U.S. patents to V. E. Johnson, Jr. are incorporated herein to the extent necessary for a complete understanding of this invention.

Figure 4:
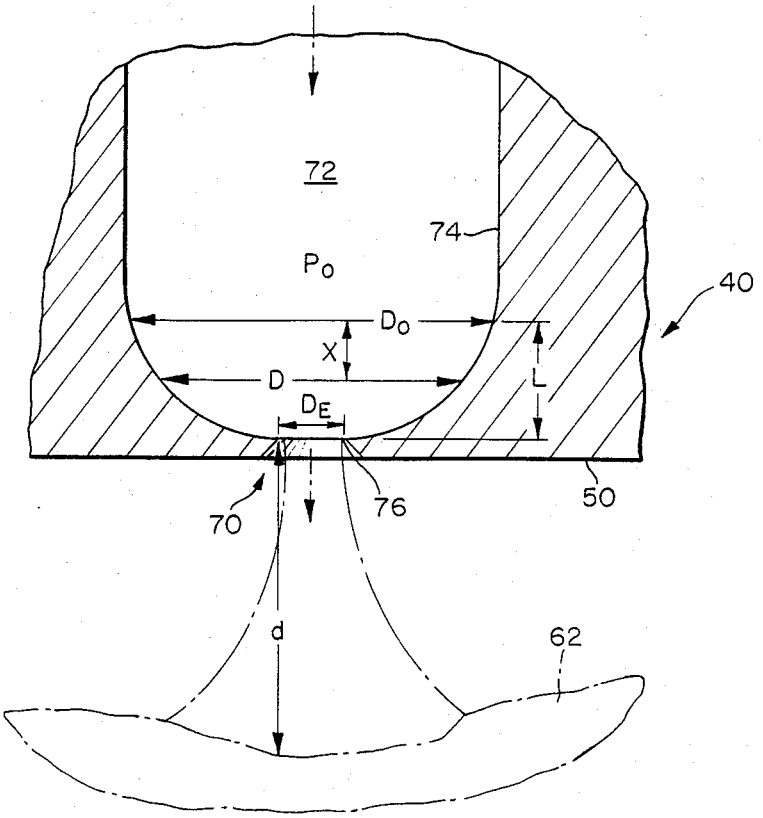
FIG. 4 is an enlarged view of a cavitating fluid jet nozzle suitable for use in the cleaning head.

An example of a cavitating liquid jet nozzle of the type described in one of the aforementioned patents is shown in FIG. 4. This nozzle 70 which can comprise the jet forming means 48 in nozzle body 40 includes an internal chamber 72 for receiving liquid such as water under pressure from chamber 44 of the nozzle body and has an interior surface 74 that tapers as shown to an outlet opening or restricted orifice 76 at the lower end of the chamber. The nozzles are so designed to rapidly raise the velocity of the fluid jet as close to the exit as possible to thereby create vortices in the exit flow having high pressure reductions or vapor cavities at their center. If the jet is caused to flow through a relatively stationary body of water, such as spent fluid from the jets, vortices are created in the shear zone between the jet and the surrounding fluid. Low pressures are created in the center of these vortices which promote the formation of the vapor cavities and further enhance the cavitational erosion effect of the nozzles, all as more fully described in the aforementioned Johnson U.S. patents.

As more particularly described in U.S. Pat. No. 4,262,757, chamber 72 contracts from an initial diameter $D_O$ to an outlet diameter $D_E$ according to the following formula:

$$\frac{D}{D_O} = 1 - \left(1 - \frac{D_E}{D_O}\right)\left(\frac{D_O}{L} \times \frac{X}{D_O}\right)^n$$

wherein $D_O$ and $D_E$ are as defined above; L is the axial length of the curved part of the nozzle; and D is the diameter at any point at a distance X from the initial diameter $D_O$; and also wherein $D_O/L$ is approximately 2 or greater; $D_O/D_E$ is 3 or greater; and n is 2 or greater.

These nozzles accelerate the exit velocity close to the orifice 76 which minimizes boundary layer thickness and vortex core size and maximizes pressure reduction in the shear zone to thereby maximize the formation of the vapor cavities. The downstream side of orifice 76 should also angle back, preferably around 45°, to maximize pressure reductions at the vortex centers.

In a preferred embodiment of the invention the jet forming means are self-exciting, acoustically resonating or pulsed cavitating fluid jet nozzles of the type described in a paper entitled "Development of Structural Cavitating Jets For Deep-Hole Bits," presented at the 57th Annual Meeting of the Society of Petroleum Engineers; Sept. 26–29, 1982 (SPE Paper 11060) or in copending application Ser. No. 215,829 filed Dec. 12, 1980 and now U.S. Pat. No. 4,389,071 entitled "Enhancing Liquid Jet Erosion", which application is assigned to the same assignee as the present invention.

Figure 5:
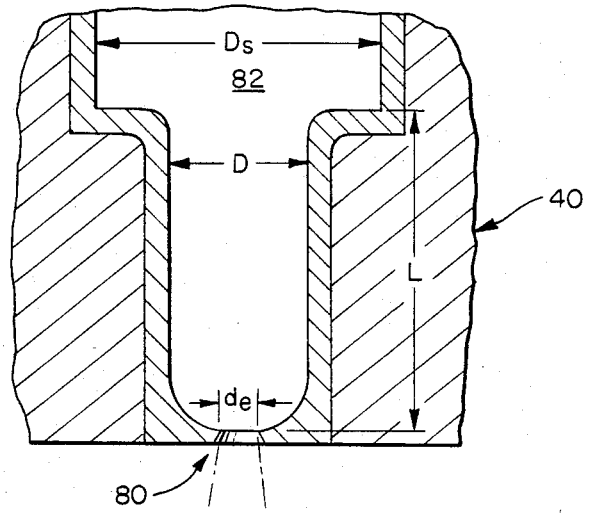
FIG. 5 is an enlarged view of a self-resonating pulsed cavitating fluid jet nozzle also suitable for use in the cleaning head.

These nozzles, an example of which is shown in FIG. 5, oscillate the velocity of the jet at a frequency selected to provide a Strouhal number within the range of from about 0.2 to about 1.2 (for cavitation numbers greater than 0.5) and from about 0.01 to 0.2 (for cavitation numbers less than 0.5), based on the diameter and velocity of the cavitating liquid jet. It was found that such induced oscillation enhances the erosion effect on the solid surface by the cavitating liquid jet.

The nozzle shown in FIG. 5 is typical of such an enhanced cavitating liquid jet and is known as an organ-pipe nozzle. It is designed to produce an oscillating cavitating water jet which structures itself into discrete vortices when submerged and is more erosive than an unexcited cavitating jet and considerably more erosive than a non-cavitating liquid jet. The nozzle 80 has a chamber 82 which initially contracts from a diameter $D_S$ to a diameter D and then to an outlet diameter $d_e$ at length L from the initial or up-stream contraction. When the length L of the nozzle is approximately equal to $d_e/4SM$, where S is the preferred Strouhal number and M is the Mach number, the jet velocity will oscillate and produce discrete vortices when it is submerged in a surrounding fluid thereby increasing the destructive power of the cavitating jet. A more specific description of the nozzle and the principles of operation of the nozzle are described in the above referred to article and U.S. Pat. No. 4,389,071 and their teachings are therefore incorporated herein by reference to the extent required for a thorough understanding of this invention.

In operation, the pipe to be cleaned is placed on idling rollers 16 and driving rollers 22 on trestles 12, 13 and against the stop arm 14. Cleaning head 26 is then inserted into the open end of the pipe and a pressurized fluid, such as water, from source 28 is fed through shaft 24 and through cleaning head 26 and into pipe 10 until the level of the water in housing 32 rises above the level of the pipe. Cleaning head 26 is located off-center with respect to the pipe's axis with the jets 48 directing their streams toward the pipe's opposite wall. As pipe 10 is rotated around the cleaning head by rollers 22, an asymmetric cutting pattern will be formed on the face 60 of the deposit in the pipe as shown in FIG. 2. The pipe should be rotated at a rate N in rpm, while the cleaning head is advanced at a rate F in inches/minute by the advancing means 30, such that the ratio of F/N, which is the advance of the head in one revolution of the pipe, is from 0.1 to 1.0 inches/revolution depending on the size of the pipe and the erodibility of the deposit within the pipe.

As the pipe rotates around cleaning head 26, the counter-thrust of the jet streams push the head against the wall of the pipe opposite from the wall towards which the jets are directed. This not only assures the formation of an asymmetric cutting pattern, but, as shown in FIG. 2, an adequate distance g between the cleaning head and the inside wall of the pipe for efficient removal of the chips from inside the pipe.

By cutting the deposit in an asymmetric fashion according to the present invention rather than in a symmetrical pattern as previously taught, it was found that excessive differential pressures were avoided, thus preventing the breaking off of large deposit-plugs, while creating chips of a more uniform size that can easily pass free of the cleaning head and out the back end of the pipe without jamming or interfering with the forward motion of the head or the rotation of the pipe.

In an experiment conducted in steel pipe having an inside diameter of 2.44 inches, a length of 33 feet and containing a deposit of fully-cured cement it was found that the system of the present invention using self-resonating pulsed cavitating fluid jet nozzles was able to remove all of the cement at a rate of 6.80 feet/minute. Thus the 33-foot length of pipe took less than 5 minutes to clean. Typical cleaning rates by conventional symmetrical systems for similar pipes and deposits have been reported to be in the range of only up to 0.50 feet/minute thus taking over an hour to clean such a pipe. The invention thus achieves over a 12-fold increase in the rate of removal of the deposit and elminates the frequent back-and-forth operation required to free-up jams in prior art systems which causes excessive wear and tear on the systems.

The cleaning head used in this experiment had a frusto-cylindrical shape with an outer diameter of 1.40 inches and a slanted face that was sloped at an angle $\alpha$ of 60° relative to the axis of the head. The distance g between the pipe and the head for removal of the chips was therefore a little over 1 inch. Two self-resonating pulsed cavitating fluid jet nozzles of the type shown in FIG. 5 were located on the face of the nozzle body of the head in vertical alignment and on either side of the nozzle body's axis as best shown in FIG. 3. The nozzles each had an orifice diameter of 0.70 inches and the upper nozzle was angled upwardly at an angle $\beta_1$ of 30° and the lower nozzle at an angle of $\beta_2$ of 20° relative to the axis of the nozzle body.

The pipe was full of water and was rotated at 140 rpm and the cleaning head was advanced at a rate of 6.80 feet/minute. Thus the ratio of F/N was 0.48 inches/-revolution. The chips created had configurations which allowed them to pass freely between the cleaning head and the inside of the pipe so that no jamming occurred. The asymmetric pattern on the surface of the deposit served to prevent buildup of excessive pressure differentials and no large deposit plugs were created.

Although in FIG. 1 the pipe 10, is shown to be rotating while the shaft 24 bearing cleaning head 26 is fed into the pipe, an alternative approach could be to have the pipe 10 stationary while the shaft and cleaning head are moved around the internal surface of the pipe in the manner taught. Suitable means, of course, would have to be provided to not only rotate shaft 24 in such a manner so that the cleaning head remains adjacent the inside wall of the pipe but to advance it as cutting of the deposit proceeds. In this case, in addition to a connection between shaft 24 and the source of pressurized fluid there would need to be a rotary-seal swivel device to permit rotation of the shaft.

Figure 6:
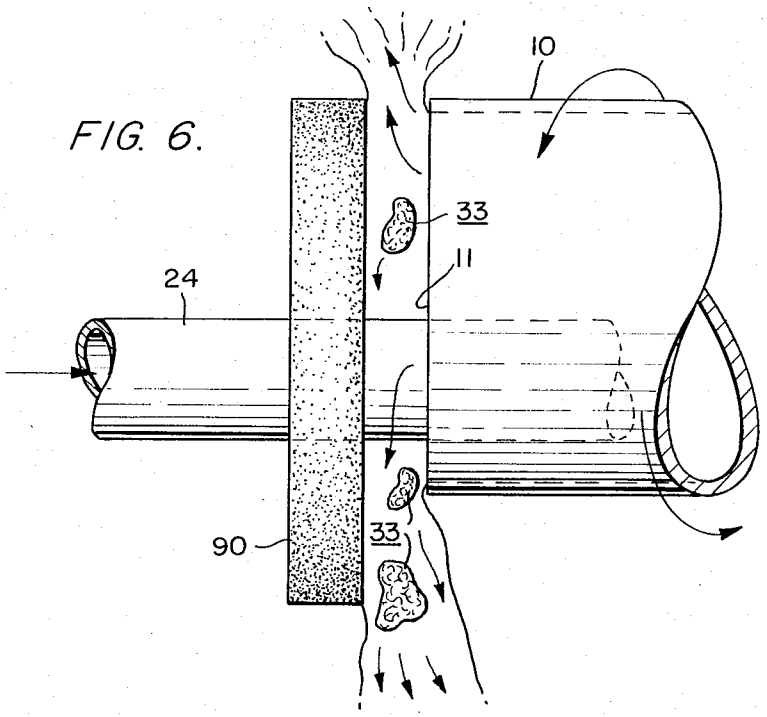
FIG. 6 is a partial view showing an alternative means for maintaining the pipe full of water during cleaning.

FIG. 6 shows an alternative and perhaps a simpler means for maintaining fluid in the pipe during the cleaning operation. As embodied, this means consists of a flow restriction or rubber dam 90, that fits snuggly around shaft 24 and is spaced from the end 11 of pipe 10 an appropriate distance to permit the chips 33 to pass out of the pipe but close enough to cause a back pressure on the fluid and slow the rate of flow, thereby achieving the desired objective of keeping the pipe full of water during cleaning. Another alternative means (not shown) would be to have an auxiliary flow source of low pressure water directing a stream of water into the pipe to keep it full of water while at the same time assisting in the washing of the chips back out of the pipe.

The present invention thus provides a new and improved apparatus and method for cleaning deposits from the inside of tubular conduits and particularly cement from inside drill pipe. While any high velocity, high pressure fluid jet nozzles may be used to create the asymmetric cutting pattern on the surface of the deposit, the invention preferably utilizes the advantageous destructive forces of cavitating liquid jets and particularly self-resonating pulsed cavitating liquid jets in the cleaning head of the present invention. Such a combination achieves a significant advantage not only in terms of an increase in the rate of removal of the deposit, but a decrease in energy requirements over high pressure liquid jets that operate under impact erosion and that cut the deposit in a symmetrical fashion.

The invention in its broader aspects is not limited to the specific details shown and described and departures may be made from such details without departing from the scope of the present invention and without sacrificing its chief advantages.

What is claimed is:

1. Apparatus for fluid jet cleaning material from the inside of a tubular component comprising:

a source of high pressure fluid;

an elongated member for running into one end of the tubular component;

a nozzle body affixed to the free end of the elongated member, said nozzle body having an internal chamber and a forward end and at least two fluid jet forming means mounted on the forward end of the nozzle body in fluid communication with the chamber for directing a plurality of high pressure fluid cutting jets in a forward direction and at an acute angle relative to a plane parallel to the axis of the tubular component so that they are directed toward one wall of the tubular component;

means for locating the nozzle body adjacent to the wall of the tubular component opposite from said one wall so that the body is offset relative to the axis of the component with at least one fluid jet forming means on the nozzle body being located on the opposite side of the axis of the tubular component from said one wall so that its fluid jet will be directed across said axis toward said one wall;

means for communicating the chamber with the high pressure fluid source;

means for providing a relative motion between the tubular component and the nozzle body so that the nozzle body moves around and remains adjacent to the wall of the tubular component opposite from said one wall; and means for advancing the elongated member and the attached nozzle body into the tubular component as erosion occurs;

whereby the fluid jets form an asymmetric cutting pattern on the surface of the material being eroded and the counterthrust of the fluid jets keeps the nozzle body offset relative to the axis of the tubular component and against the wall opposite from said one wall to provide passage for removal of the eroded material and spent fluid out of the end of the tubular component.

2. The apparatus of claim 1 wherein the nozzle body is sized relative to the tubular component to provide a passage of from 1 to 2 inches between the nozzle body and the said one wall of the tubular component.

3. The apparatus of claim 1 wherein the means for moving the nozzle body relative to the tubular component rotates the tubular component about its axis.

4. The apparatus of claim 1 wherein the elongated member is a hollow shaft connected at one end to the nozzle body to locate it adjacent to an inner wall of the tubular component and for communicating the source of high pressure fluid with the nozzle body's chamber.

5. The apparatus of claim 1 including baffle means for maintaining the tubular component full of fluid.

6. The apparatus of claim 5, wherein the baffle means comprises a dam affixed to the elongated member for restricting the flow of fluid passing out of the tubular component.

7. The apparatus of claim 5, wherein the baffle means comprises a housing surrounding the open end of the tubular component for receiving the flow of fluid exiting the tubular component, said housing having an exit port above the level of the tubular component.

8. The apparatus of claim 1, wherein the nozzle body is frusto-cylindrical in shape with a sloped face facing toward the said one wall of the tubular component, the exit orifices of the jet forming means being located in the sloped face of the nozzle body.

9. The apparatus of claim 8 wherein the sloped face of the nozzle body slopes at an angle of from 50° to 70° relative to the axis of the nozzle body.

10. The apparatus of claim 8 wherein the cutting jets are directed forwardly at an angle of from 10° to 50° relative to the axis of the nozzle body.

11. The apparatus of claim 8 wherein the orifices of the jet forming means are spaced along a plane that runs through the axis of the tubular component and the nozzle body and are located both above and below the axis of the nozzle body.

12. The apparatus of claim 8 wherein the jet forming means are cavitating liquid jet nozzles that cause cavitational erosion of the surface of the deposit.

13. The apparatus of claim 12 wherein the jets are self-resonating pulsed cavitating liquid jet nozzles.

14. A method for cleaning material from the inside of a tubular component with high velocity fluid jets comprising:

positioning a nozzle body adjacent to one wall of the tubular component so that the body is offset relative to the axis of the component, the nozzle body having at least two fluid jet forming means mounted on its forward end for directing a plurality of angled high pressure fluid cutting jets in a direction forward of the nozzle body, the angle of the jets being such that they are only directed toward the wall of the tubular component opposite said one wall and the nozzle body being located so that the cutting jet of at least one of the jet forming means will be directed across the axis of the tubular component;

providing high pressure fluid to the jet forming means;

moving the tubular component and the nozzle body so that the nozzle body moves around and remains adjacent to the inside wall of the tubular component; and advancing the nozzle body into the tubular component as the material is eroded whereby the fluid jets form an asymmetric cutting pattern on the surface of the material being eroded and the counterthrust of the fluid jets keeps the nozzle body offset relative to the axis of the tubular component and against said one wall of the tubular component to provide passage for removal of the eroded material and spent fluid out of the end of the tubular component.

15. The method of claim 14, wherein the tubular component is rotated about its axis at a speed N in rpm relative to the advancement F in inches/minute of the nozzle body such that the ratio of F/N is from 0.1 to 1 inches/revolution.

16. The method of claim 14, wherein the jets are angled forwardly at an angle of from 10° to 50° relative to the axis of the nozzle body.

17. The method of claim 14, wherein the tubular component is rotated about its axis to move the nozzle body around the inside wall of the component.

18. The method of claim 14, wherein the fluid jets are cavitating liquid jets.

19. The method of claim 18, including maintaining the tubular component full of fluid as the material is eroded by the jets.

20. The method of claim 19, wherein the fluid in the tubular component is spent liquid from the jets.

21. The method of claim 18, wherein the fluid is water.

22. The method of claim 18, wherein the cavitating liquid jets are self-resonating pulsed cavitating liquid jets.

23. The apparatus of claim 1, where all of the fluid jet forming means on the nozzle are located on the opposite side of the axis of the tubular component from said one wall.

24. The apparatus of claim 23 including two fluid jet forming means both of which are spaced along a plane that runs through the axis of the tubular component.

25. The apparatus of claim 24 wherein the two fluid cutting jets are directed forwardly at an angle of from 10° to 50°.

26. The apparatus of claim 25 wherein the fluid jet forming means nearer the axis of the tubular component is directed forwardly at an angle of approximately 30° and the one nearer the wall opposite from said one wall is directed forwardly at an angle of approximately 20°.

27. The apparatus of claim 26 wherein the jet forming means are cavitating liquid jet nozzles that cause cavitational erosion of the surface of the deposit.

28. The apparatus of claim 27 wherein the jets are self-resonating pulsed cavitating liquid jet nozzles.

29. The method of claim 14, where all of the fluid jet forming means on the nozzle are located on the same side of the axis of the tubular component as said one wall.

30. The method of claim 29 including two fluid jet forming means with both being spaced along a plane that runs through the axis of the tubular component.

31. The method of claim 30 wherein the two fluid cutting jets are directed forwardly at an angle of from 10° to 50°.

32. The method of claim 31 wherein the fluid jet forming means nearer the axis of the tubular component is directed forwardly at an angle of approximately 30° and the one nearer said one wall is directed forwardly at an angle of approximately 20°.

33. The method of claim 32 wherein the jet forming means are cavitating liquid jet nozzles that cause cavitational erosion of the surface of the deposit.

34. The method of claim 33 wherein the jets are self-resonating pulsed cavitating liquid jet nozzles.

35. The method of claim 29, wherein the tubular component is rotated about its axis at a speed N in rpm relative to the advancement F in inches/minute of the nozzle body such that the ratio of F/N is from 0.1 to 1 inches/revolution.

* * * * *